US005464034A

United States Patent [19]

Kestin

[11] Patent Number: 5,464,034

[45] Date of Patent: Nov. 7, 1995

[54] POCKET-PORTABLE RAIN COVERING

[76] Inventor: Hesh Kestin, 38 Halsey La., Remsenburg, N.Y. 11960

[21] Appl. No.: 313,013

[22] Filed: Sep. 27, 1994

[51] Int. Cl.[6] ..... E04H 15/04

[52] U.S. Cl. ..... 135/90; 135/98; 135/20.2

[58] Field of Search ..... 135/90, 95, 98, 135/99, 115

[56] References Cited

U.S. PATENT DOCUMENTS

| | | | |
|---|---|---|---|
| 574,091 | 12/1896 | Irvine, Jr. | 135/96 |
| 2,412,415 | 12/1946 | Navon | 135/16 X |
| 2,679,256 | 5/1954 | Bocchino et al. | 135/20.2 |
| 2,684,483 | 7/1954 | Kwake | 135/20.2 X |
| 3,361,145 | 1/1968 | Jones | 135/20.2 |
| 4,825,578 | 5/1989 | Robinson | 135/90 X |
| 5,040,555 | 8/1991 | Wang | 135/20.2 |
| 5,197,216 | 3/1993 | Norris | 135/90 X |

FOREIGN PATENT DOCUMENTS

| | | | |
|---|---|---|---|
| 2302 | 6/1890 | Switzerland | 135/16 |

*Primary Examiner*—Lanna Mai
*Attorney, Agent, or Firm*—Kelly & Hulme

[57] ABSTRACT

A pocket portable rain covering for use in covering the entire body of a user. The device is comprised of an inflatable cap for placement atop the user's head and a curtain extending downward from the perimeter of said cap member such that a cylinder is provided within which the user may be disposed and protected from the elements.

2 Claims, 1 Drawing Sheet

POCKET-PORTABLE RAIN COVERING

BACKGROUND OF THE INVENTION

1. Field of the Invention

The present invention pertains to the field of rain gear and more particularly to a pocket-portable rain covering.

2. Description of the Prior Art

It is often the case that a person leaves home without the proper rain gear and gets caught in a suprise or unpredicted rain storm or other inclement weather. Furthermore, sports fans are often caught in foul weather at out door sporting events without appropriate rain gear. In order to prevent this in the past, individuals would have to carry rain gear, which is often bulky and cumbersome, with them and try to anticipate the weather or to purchase rain gear at the time they are caught in the foul weather, which gear is often only available at a steep price.

It is therefore an object to the present invention to provide foul weather gear that is easily unobtrusively portable.

It is yet another object of the present invention to provide portable rain gear which protects the user's entire body.

It is still another object of the present invention to provide pocket-portable rain gear which does not obstruct the view of the user.

These and other objects of the present invention shall become apparent from the following specification, read in conjunction with the appended claims and attached drawings.

SUMMARY OF THE INVENTION

In accordance with the teachings of the present invention, there is herein described and illustrated a pocket portable rain covering comprised of an inflatable cap member, and a transparent curtain member suspended from the perimeter of the cap member. The cap member when inflated can be placed on top of the user's head such that a curtain portion extends down therefrom and completely around the body of the user. The curtain may define slots therethrough at appropriate locations to allow the hands of the user to be extended out of the device while being worn. The curtain may also contain other appropriately placed openings to allow for communication by or to the user, as well as to provide for the adequate ventilation of the device.

BRIEF DESCRIPTIONS OF THE DRAWINGS

DETAILED DESCRIPTION OF THE INVENTION

Figure 5:
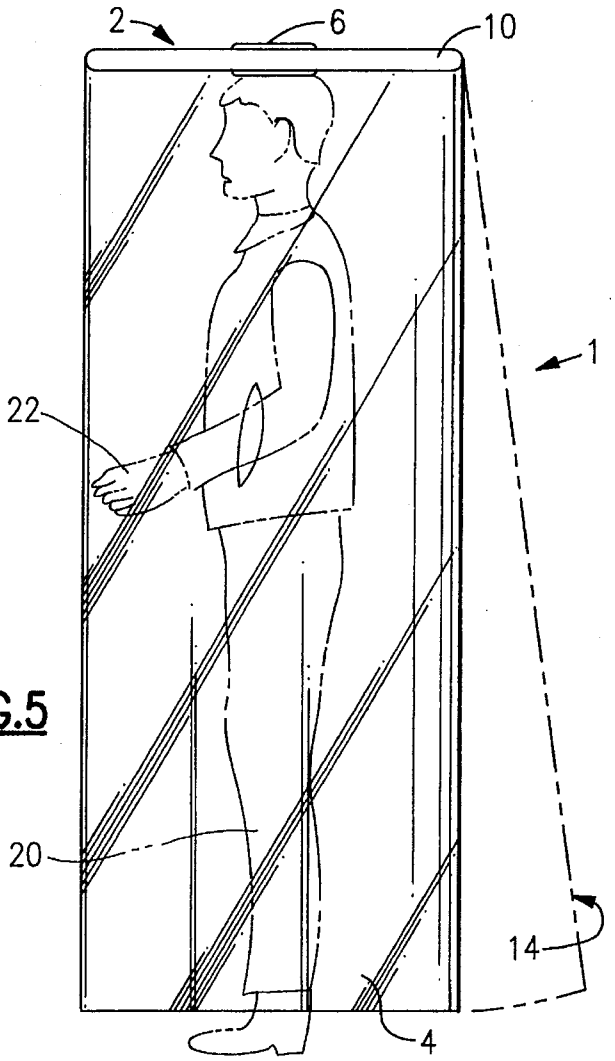
FIG. 5 is a side view of the rain covering of the present invention showing the covering in use.

Referring now to the drawings, a pocket portable rain covering 1 is shown and is comprised of a cap member 2 which when inflated, as discussed below, may be placed on top of the head of a user 20; and a curtain member 4 which is suspendable from and extends downward from the perimeter of the cap member 2 such that it extends around and along the length of the user 20, and thereby protect the user from wet weather.

The cap member 2 of the present invention 1 is mouth-inflatable through inflation tube 16 and is comprised of a central cap 6, an annular ring 10 and plurality of spokes 8 radiating outward from the cap 6 and connecting to the annular ring 10. The central cap 6, annular ring 10 and spokes 8 together define an air space within said cap member 2. The cap member 2 is further comprised of an inflation tube 16 which is in communication with said air space. The free end of the inflation tube 16 is adapted to be inserted into the mouth of the user for inflating or deflating the device 1 as desired. A one-way valve and removable air stopper (not shown) may be provided within the inflation tube 16 to facilitate the inflation and deflation of the device.

When the air space within the cap member 2 is fully inflated, a generally flat, semi-rigid disc is produced which may then be placed on the user's head with the central cap 6 being balanced thereon and the curtain 4 being suspended downward for the annular ring 10 such that it extends around and over the length of the body of user 20 as shown in FIG. 5.

The rain covering 1 of the present invention further defines slots 12 positioned in curtain member 4 such that when the covering 1 is worn, the user's hands 22 may easily and comfortably extend out of the covering 1. Finally, the curtain member 4 defines a slot 14 extendeding downward from the cap member 2 and along the entire length of the curtain member 4 to allow for easy ingress into and egress from the device 1 of the present.

Figure 2:
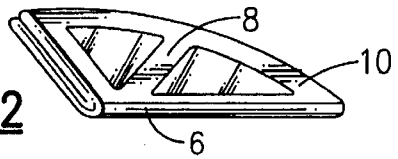
FIG. 2 is a view of the rain covering in its unused and portable orientation.
Figure 3:
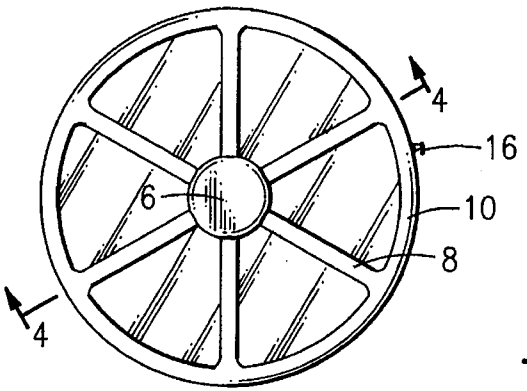
FIG. 3 is a top view of the rain covering of the present invention.
Figure 4:
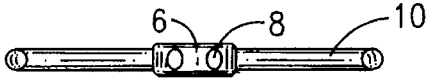
FIG. 4 is a view of the rain covering of the present invention taken along line 4—4 of FIG. 3.

The rain covering 1 of the present invention, when not inflated may be folded, as shown in FIG. 2, into a relatively small size which may then be transported in a pocket, small bag, purse, attache case or the like until needed when it can be easily inflated or re-inflated for use.

The cap and curtain members, 2 and 4 respectively, may be formed from any suitable flexible, light weight material such as any of the plastics having these attributes that are currently available. The materials chosen must be at a minimum water resistant and more preferably water proof. In addition, in a preferred embodiment, the material chosen for the curtain member is transparent, at least at a location adjacent to the user's body 20 eyes and preferably entirely transparent in order to provide the device user 20 the maximum level of vision.

Figure 1:
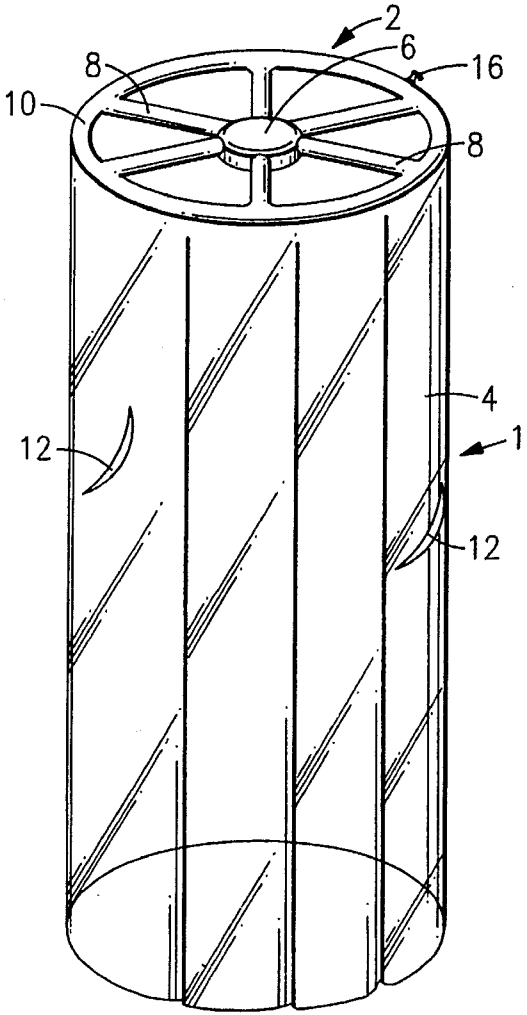
FIG. 1 is a perspective view of the rain covering of the present invention.

As can be seen in FIGS. 1 and 5, the curtain 4 is affixed to annular ring 10 around its entire perimeter such that no space exists between the ring 10 and curtain 4 which prevents leakage of the elements into the rain cover 2. This attachment may be accomplished in any manner commonly known in the art such as heat sealing, glue and the like.

While various embodiments of the present invention have been disclosed herein, it will be recognized by those skilled in the art that modifications of the present invention maybe made without departing from the scope of the present invention. Therefore, the limits of the present invention are to be determined in view of the claims which follow.

What is claimed is:

1. A pocket-portable rain covering comprised of a:

an inflatable cap member receivable over a human head including a central cap receivable on the top of said head, an annular ring disposed around said central cap and a plurality of spokes extending radially outward from said central cap and to said annular ring, the cap, ring and spokes each forming an internal space therein, said internal spaces being interconnected to define a continuous air space within said cap member;

a transparent curtain being fixedly attached to and hanging freely from said annular ring; such that a cylinder extending downward from said cap member is provided within which a person may be completely covered and protected from the elements; and an inflatable tube in communication with said continuous air space for inflation and deflation of said cap member.

2. The rain covering of claim 1 defining appropriately located slots throughout the curtain thereof to provide access to and from the covering and to provide for adequate ventilation.

* * * * *